United States Patent [19]

Formo et al.

[11] Patent Number: 4,524,512

[45] Date of Patent: Jun. 25, 1985

[54] NESTABLE, STACKABLE CUTLERY

[75] Inventors: Jerome L. Formo, St. Paul, Minn.; Albert C. Lasher, New York, N.Y.; Robert W. White, Oklahoma City, Okla.

[73] Assignee: O Tray Corporation, Oklahoma City, Okla.

[21] Appl. No.: 488,564

[22] Filed: Apr. 25, 1983

[51] Int. Cl.[3] ..... A47J 43/28; A47J 45/06

[52] U.S. Cl. ..... 30/147; 30/150

[58] Field of Search ..... 30/147, 148, 149, 150; 206/499; 220/23.8; D7/138, 148

[56] References Cited

U.S. PATENT DOCUMENTS

| | | | |
|---|---|---|---|
| 719,208 | 1/1903 | Garda | 30/148 |
| 1,425,750 | 8/1922 | Crawford | 30/148 |
| 1,762,635 | 6/1930 | Lambert | 220/23.8 |
| 2,216,005 | 9/1940 | Goldstein | 30/150 |
| 2,674,793 | 4/1954 | Dominick | 30/150 |
| 2,752,678 | 7/1956 | Welch | 206/499 |
| 3,032,184 | 5/1962 | Kuster | 206/499 |
| 4,317,284 | 3/1982 | Prindle | 30/147 |

FOREIGN PATENT DOCUMENTS

| | | | |
|---|---|---|---|
| 1178122 | 8/1946 | France | 30/147 |
| 411717 | 12/1945 | Italy | 30/147 |
| 579949 | 8/1946 | United Kingdom | 30/147 |
| 807255 | 1/1959 | United Kingdom | 30/148 |

*Primary Examiner*—Paul A. Bell
*Assistant Examiner*—Paul M. Heyrana, Sr.
*Attorney, Agent, or Firm*—Peterson, Wicks, Nemer & Kamrath

[57] ABSTRACT

Nestable, stackable cutlery is shown according to the teachings of the present invention in the form of spoons, forks, and knives. The cutlery includes handle portions, of generally identical construction, and food operational and engagement portions. The handle portions in the preferred embodiment have a U-shaped cross section allowing the outside surface of a first piece of cutlery to be received within the inside surface of a second piece of cutlery. The cutlery further includes nesting and stacking lugs for supporting the handle portion of the second piece of cutlery along its entire length on the handle portion of the first piece of cutlery. In their most preferred form, the lugs include an inverse tapered inner surface for holding onto a punch of an injection mold during fabrication. In the preferred embodiment, the food operational and engagement portions of the cutlery have unique constructions allowing the food operational and engagement portions to lie within a single overall outline, and in the most preferred form, to lie generally within the outline of the bowl portion of the spoon when a spoon, a fork, and a knife are stacked and nested together.

15 Claims, 7 Drawing Figures

NESTABLE, STACKABLE CUTLERY

SUMMARY

The present invention relates generally to cutlery, specifically to plastic cutlery, and more particularly to nestable, stackable cutlery.

Known prior cutlery had severe limitations in regard to the formation, packaging, storage, dispensing, and handling of the cutlery. The present invention solves these and other limitations and problems in cutlery by providing, in the preferred embodiment, cutlery including a plurality of utensils having handle portions and food operational and engagement portions. The handle portions include stacking and nesting type surfaces allowing the utensils to be stacked and nested together. The handle portions in the preferred embodiment further include stacking and nesting lugs for supporting the handle portions of the cutlery along their entire length in their stacked, nested positions.

Furthermore, the cutlery of the present invention further provides, in the preferred embodiment, unique food operational and engagement portions. Specifically, the spoon includes an elongated, oval-shaped bowl portion, the fork includes a complementary shaped tine portion, and the knife includes a complementary shaped blade portion such that when the spoon, fork, and knife are stacked together, the food operational and engagement portions lie within the outline of the bowl portion of the spoon to protect the food operational and engagement portions of the cutlery and to prevent the food operational and engagement portions from poking or cutting through the packaging of the cutlery.

It is thus a primary object of the present invention to provide novel cutlery.

It is further an object of the present invention to provide such novel cutlery which is nestable and stackable.

It is further an object of the present invention to provide such novel nestable, stackable cutlery including lugs formed on the stacking and nesting type surface for supporting the handle portions of the cutlery along their entire length in their stacked, nested positions.

It is further an object of the present invention to provide such novel nestable, stackable cutlery which can be stacked in relatively low height stacks.

It is further an object of the present invention to provide such novel nestable, stackable cutlery which can be stacked in stacks having high structural integrity and in relatively stable stacks.

It is further an object of the present invention to provide such novel nestable, stackable cutlery which lends itself to dispenser situations.

It is further an object of the present invention to provide such novel cutlery including advantageous packaging considerations.

It is further an object of the present invention to provide such novel cutlery having uniquely constructed food operational and engagement portions which remain in a single overall outline when a spoon, a fork, and a knife are stacked together.

It is further an object of the present invention to provide such novel cutlery wherein when a spoon, a fork, and/or a knife are stacked together, the food operational and engagement portions are protected from breakage and the packaging thereof is protected against poking and cutting therethrough.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
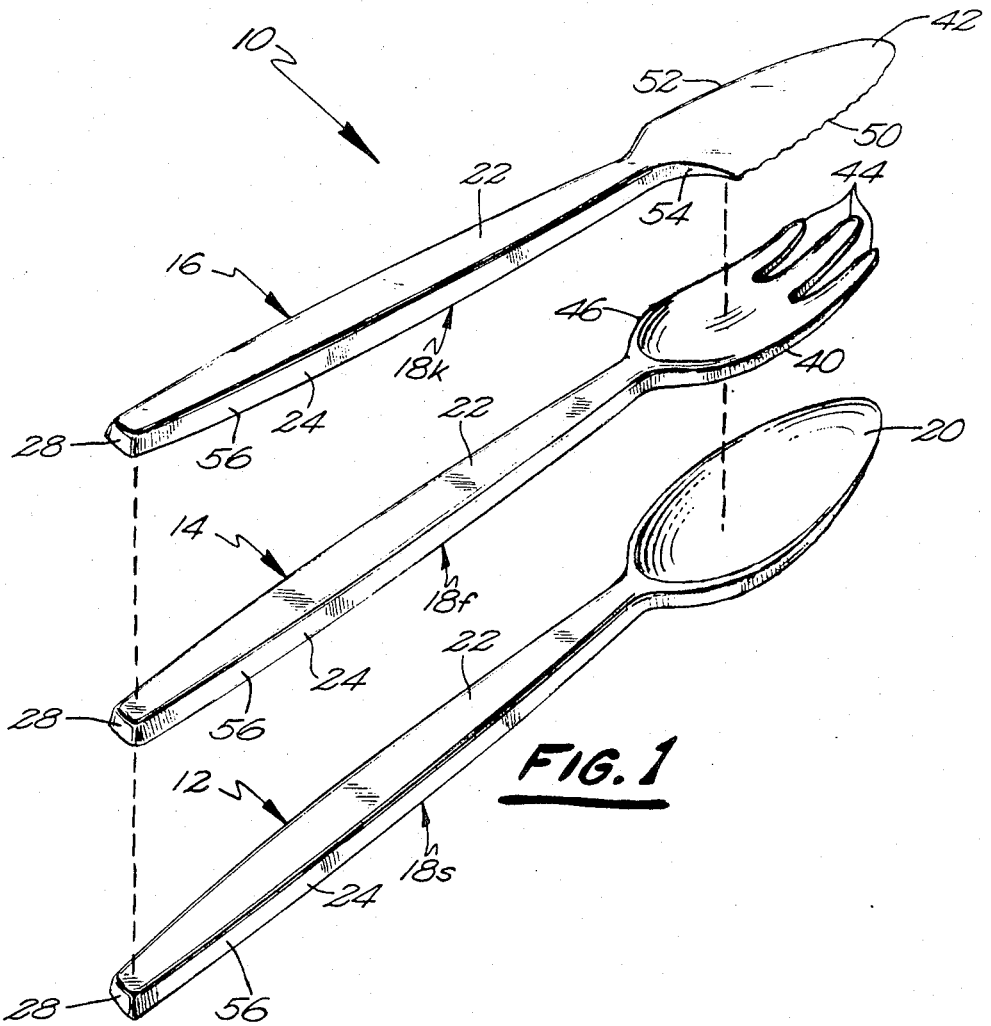
FIG. 1 shows an exploded perspective view of cutlery according to the teachings of the present invention.

All figures are drawn for ease of explanation of the basic teachings of the present invention only; the extensions of the figures with respect to number, position, relationship, and dimensions of the parts to form preferred embodiments will be explained or will be obvious from the explanation given.

Where used in the various figures of the drawings, the same numerals designate the same or similar parts in the cutlery. Furthermore, when the terms "first", "second", "end", "edge", "top", "bottom", "inside", "outside", and similar terms are used herein, it should be understood that these terms have reference only to the structures shown in the drawings as it would appear to a person viewing the drawings and are utilized only to facilitate describing the invention.

DESCRIPTION

Nestable, stacking cutlery is shown in its preferred form in the drawings and generally designated 10. Cutlery 10 includes in its most preferred form a set of cutlery comprising a spoon 12, a fork 14, and a knife 16.

Figure 4:
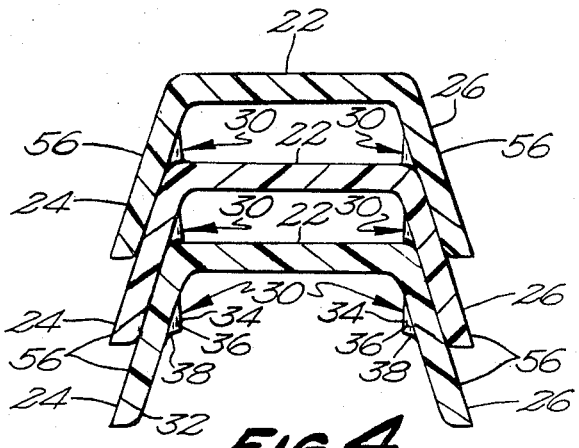
FIG. 4 shows a cross sectional view of the cutlery of FIG. 1 according to section line 4—4 of FIG. 2.

Spoon 12 in the preferred embodiment includes a handle portion 18*s* and a bowl portion 20. Handle 18*s* has a generally U-shaped cross section and includes a flat top portion 22 and two depending leg portions 24 and 26 which extend at an obtuse angle from the opposite edges of top portion 22. Handle 18*s* further includes at its first end an end portion 28 which extends at an obtuse angle from top portion 22 which is equal to the obtuse angle which portions 24 and 26 extend from portion 22. End portion 28 is arcuately attached to leg portions 24 and 26. In its most preferred form, the obtuse angle at which portions 24, 26, and 28 are attached to portion 22 is equal to 108°. As best seen in FIG. 4, the inside and outside corners at the intersection of portions 22, 24, and 26 and the inside corners of the free ends of portions 24 and 26 are rounded for molding and appearance considerations. The outside surface of top portion 22 can include indicia, decorations, or the like, if desired.

Handle 18*s* further includes lugs 30 formed in the interior surface 32 of portions 24 and 26. In their most preferred form, three or four lugs 30 are formed on each of portions 24 and 26; however, fewer, more, or continuous lugs can be provided according to the teachings of the present invention. Lug 30 in its most preferred form is generally wedge shaped and includes an inside surface 34, a second surface 36 formed integrally with inside surface 32 of portions 24 and 26, and a curved surface 38 extending between surface 34 and surfaces 32 and 36. In its most preferred form, curved surface 38 has a shape corresponding and complementary to the outside corners of the intersection of portions 22, 24, and 26. The angle of intersection between surface 34 and surface 36 which is concurrent with surface 32 is equal to approximately one degree more than the number of degrees over 90° of the obtuse angle between portions 24 and 26 and portion 22. Thus, in the most preferred form, the angle between top portion 22 and surface 34 of lugs 30 is generally equal to 89° and such that surfaces 34 of lugs 30 are not parallel to each other but rather are in planes which converge towards each other at a point spaced from top portion 22.

Fork 14 includes a handle portion 18*f* and a tine portion 40. In its most preferred form, handle 18*f* has a generally identical construction as handle 18*s* of spoon 12.

Knife 16 includes a handle portion 18*k* and a blade portion 42. In its most preferred form, handle portion 18*k* has a generally identical construction as handle 18*s* of spoon 12 and handle 18*f* of fork 14.

Examining the food operational and engagement portions of spoon 12, fork 14 and knife 16 of cutlery 10 in more detail, bowl portion 20 of spoon 12 has an elongated oval shape in the preferred embodiment. In its most preferred form, portion 20 has a length in the range of two and one half inches, a width in the range of one and one sixteenth inch, and a depth in the range of one quarter inch. Bowl portion 20 of the present invention has the oval shape rather than the round shape of bowl portions of prior spoons for several reasons. First, the mouth of humans is proportionally deeper than the bowl portion of prior art spoons and the bowl portion 20 according to the teachings of the present invention takes advantage of this depth. Second, bowl portion 20 according to the teachings of the present invention acts as a protector in protecting the operational portion of fork 14 and knife 16 in a stacked condition.

Figure 3:
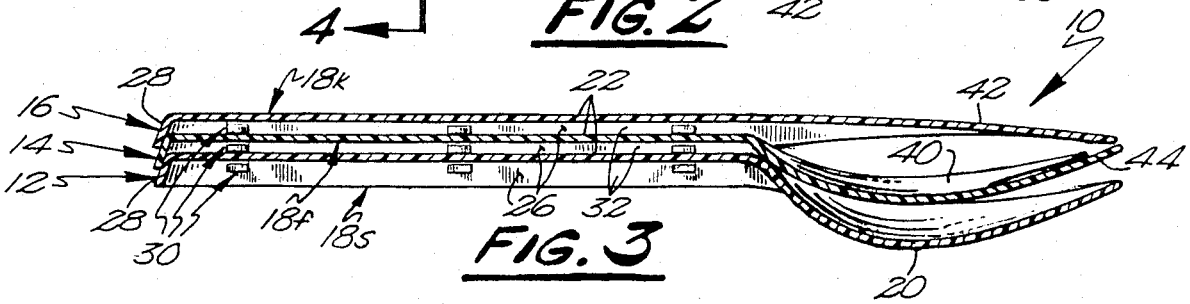
FIG. 3 shows a cross sectional view of the cutlery of FIG. 1 according to section line 3—3 of FIG. 2.
Figure 7:
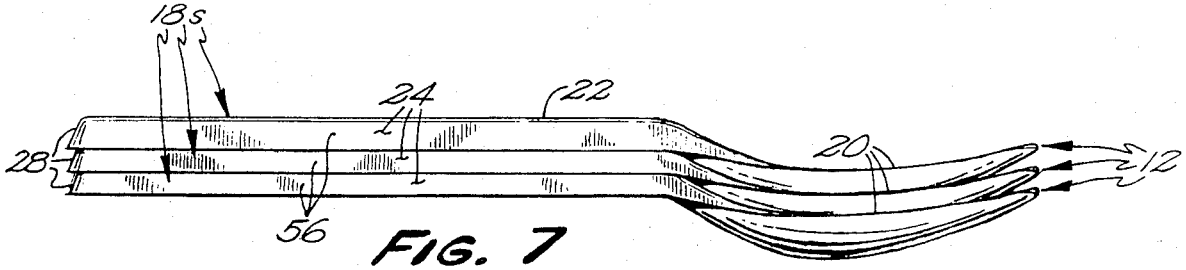
FIG. 7 shows a side view of a stack of spoons of the cutlery of FIG. 1.

In its most preferred form, portions 24 and 26 terminate in bowl portion 20 as best seen in FIGS. 3 and 7 and act as a brace or strengthening portion to aid in preventing bowl portion 20 from bending or breaking relative to handle 18*s*.

Figure 2:
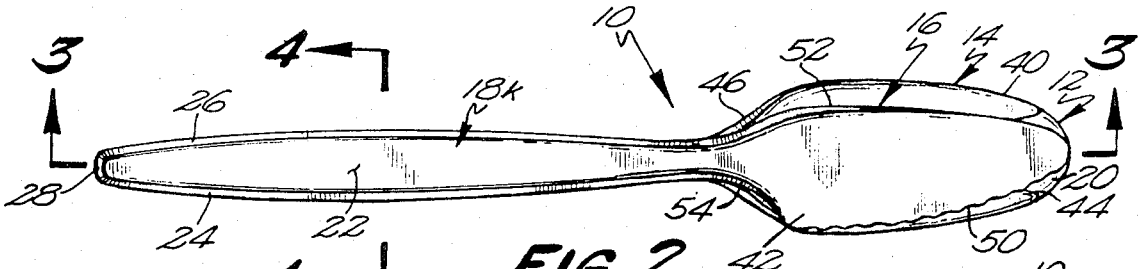
FIG. 2 shows a top view of the cutlery of FIG. 1 in a stacked, nested relation.
Figure 6:
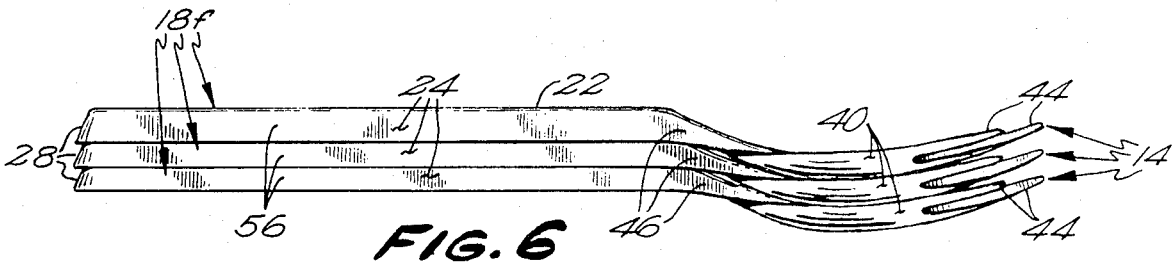
FIG. 6 shows a side view of a stack of forks of the cutlery of FIG. 1.

In its most preferred form, tine portion 40 has a length and width equal to bowl portion 20 of spoon 12. Tine portion 40 of fork 14 includes in its most preferred form three tines 44 and a handle interconnection portion 46. Three tines 44 are used rather than the standard four tines used in prior cutlery for several reasons. First, tine portion 40 can be made narrower so that it has the same width as bowl portion 20 of spoon 12, which width is less than the standard width of prior forks and prior spoons. Second, more material is used in fabricating tines 44 and thus they are of a stronger design that if four tines were used. Next, as best seen in FIGS. 1, 3, and 6, the outside tines 44 can be made shorter than the middle tine 44 of tine portion 40 according to the teachings of the present invention. Specifically, although the operational length of tine portion 44 is maximized, the tine portion 40 of fork 14 keeps in the outline of bowl portion 20 of spoon 12 when fork 14 is stacked on top of or above spoon 12 as best seen in FIGS. 2 and 3 according to the teachings of the present invention. Thus, tines 44 are protected from breakage due to catching on objects as would occur if the tines extended beyond the outline of bowl portion 20 of spoon 12. Likewise, tines 44 do not poke through the packaging such as cellophane, heat shrunk plastic, and the like in which cutlery 10 is packaged because bowl portion 20 of spoon 12 acts as an abutment and protection edge in preventing tines 44 from poking through the packaging.

In its most preferred form, portions 24 and 26 terminate in handle interconnection portion 46 of tine portion 40 as best seen in FIGS. 3 and 6 to aid in preventing tine portion 40 from bending or breaking relative to handle portion 18*f*.

In its most preferred form, the length of blade portion 42 is generally equal to the length of bowl portion 20 of spoon 12 and tine portion 40 of fork 14. The width of blade portion 42 is less than the width of bowl portion 20 of spoon 12 and tine portion 40 of fork 14. It should then be noted the length of blade portion 42 is considerably shorter than blade portions of prior knives. Specifically, prior knives had blade portions which are sufficient to butter a whole slice of bread. However, this function has been discovered to be not required in most situations where plastic cutlery is utilized, for example, in airline situations, but rather knives are required for cutting means, buttering rolls, and like functions. Thus, knife 16 according to the teachings of the present invention has a blade portion 42 of a unique, much shorter design that is able to perform functions required in plastic cutlery situations.

Furthermore, since cutting has been discovered to be the primary function of knife 16, only a single serated edge 50 is provided on blade portion 42 with the other edge including a reinforcing rib 52. Rib 52 allows more material to be used in the formation of blade portion 42 thus increasing its strength. In its most preferred form, rib 52 is formed contiguous and integral with portion 24 of handle portion 18*k*. A further partial rib 54 is further provided as a radius between portion 26 of handle 18*k* and serated edge 50 of blade portion 42. Thus, knife 16 according to the teachings of the present invention has a great relative strength to aid in preventing blade portion 42 from bending or breaking relative to handle portion 18*k*.

Additionally, the unique design of blade portion 42 obtains packaging consideration advantages. Specifically, knife 16 has a total length equal to that of spoon 12 and fork 14 rather than longer as in the prior art. Second, blade portion 42 keeps in the outline of bowl portion 20 of spoon 12 and tine portion 40 of fork 14 when knife 16 is stacked on top of or above spoon 12 and/or fork 14 as best seen in FIGS. 2 and 3 according to the teachings of the present invention.. Thus, serated edge 50 of blade portion 42 does not cut through the packaging of cutlery 10 such as cellophane, heat shrunk plastic, and the like because bowl portion 20 of spoon 12 acts as a stacking protector and as an abutment and protection edge in preventing edge 50 from cutting through the packaging. Similarly, blade portion 42 acts as a protector to tines 44 of fork 14 when fork 14 is sandwiched between knife 16 and spoon 12 as best seen in FIGS. 2 and 3.

Cutlery 10 according to the teachings of the present invention also obtains several advantages because of their ability to be stacked and nested. Specifically, handles portions 18 of cutlery 10 of the present invention have several subtle features which can now be explained and appreciated. Prior to the present invention, known cutlery was stacked on the thickest point, typically, at the junction of the handle portion and the food operational and engagement portion, and not along the entire length of the handle portion, did not include nesting provisions, were very unstable in a stacked condition, did not allow different types of cutlery to be attached together, resulted in stacks of relatively high heights, and like disadvantages. The present invention solves these and other problems of prior cutlery because of the unique features of handle portions 18 and the food operational and engagement portions of cutlery 10.

Figure 5:
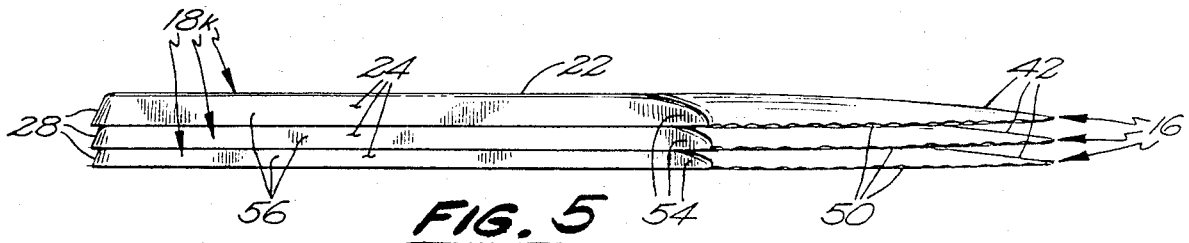
FIG. 5 shows a side view of a stack of knives of the cutlery of FIG. 1.

Specifically due to the construction of handle portions 18 of cutlery 10, and particularly the angular relationship of portions 24 and 26 and portion 22, handle portions 18 can be stacked and nested on each other such that inside surfaces 34 of portions 24 and 26 can be positioned on top of outside surfaces 56 of portions 24 and 26 of a second handle portion 18 of another piece of cutlery 10. Furthermore, lugs 30 abutting with the outside corners of the intersection of portions 22, 24, and 26 and allow handle portions 18 of cutlery 10 to be stacked and supported along the entire length of handle portion 18 and not at a thickest point as in prior cutlery. Due to this nesting and stacking provisions, stacks of a single type of cutlery such as spoons, forks, or knives, as shown in FIGS. 5–7, have a relatively low height, and specifically have a height of less than 12 inches for 100 pieces of cutlery 10 in the most preferred embodiment of the present invention. Of course, it should be appreciated that the height of a stack varies with the angular relation between portions 24 and 26 and portion 22 and other considerations. Furthermore, due to this nesting ability, a stack of the same kind of cutlery as shown in FIGS. 5–7 has a high structural integrity and thus it is of a very stable design. Additionally, according to the teachings of the present invention, handle portion 18*f* can be stacked and nested on top of and along the entire length of handle portion 18*s*, and handle portion 18*k* can be stacked and nested on top of and along the entire length of handle portion 18*f* or handle portion 18*s*, such that a set of cutlery 10 can be stacked and nested as best seen in FIGS. 2–4 to gain the packaging consideration advantages set forth hereinbefore.

Additionally, the reverse taper of surface 34 provides injection consideration advantages over prior cutlery. Specifically, the reverse taper of surface 34 allows the piece of cutlery to be held on the punch of an injection mold during formation allowing automatic operation of the injection mold. Thus, lugs 30 have dual functions and obtain formation and nesting and stacking advantages.

In addition to the production, assembly, storage, and uses advantages set forth, cutlery 10 according to the present invention obtains further and similar advantages. For example, due to the U-shaped cross section of handle portion 18, portions 24 and 26 act as reinforcement ribs such that handle portion 18 has a great relative strength requiring a minimum of width, thickness, and material in addition to providing the stacking and nesting ability set forth. Additionally, cutlery 10 according to the teachings of the present invention is especially adapted for and advantageous for use in dispenser situations.

Now that the basic teachings of the present invention have been explained, many extensions and variations will be obvious to one having ordinary skill in the art. For example, cutlery 10 according to the teachings of the present invention includes several unique features which cooperate together to form a synergistic combination having an accumulation of advantages. However, these unique features can be utilized separately or with further, substituted or additional features according to the teachings of the present invention.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description and all changes which come within the meaning and range of the equivalency of the claims are intended to be embraced therein.

What is claimed is:

1. Nestable, stackable cutlery comprising, in combination: a spoon having a handle portion and a bowl portion; a fork having a handle portion and a tine portion; a knife having a handle portion and a blade portion, with the handle portions of the spoon, fork, and knife having a substantially identical construction, with the handle portions of the spoon, fork, and knife including a generally U-shaped cross section comprising, in combination: a flat top portion having a first end, a second end, a first edge, a second edge, an outside surface, and an inside surface; and first and second leg portions, with the first and second leg portions including a first end, a second end, a first edge, a second edge, an outside surface, and an inside surface, with the first edge of the first leg portion being attached at an obtuse angle to the first edge of the top portion and with the first edge of the second leg portion being attached at an obtuse angle to the second edge of the top portion, with the distance between the second edges of the first and second leg portions being greater than the distance between the first and second edges of the top portion allowing the handle portions of the spoon, fork, and knife to be stacked and nested together, with the handle portions further including means for supporting the handle portion along its entire length on the handle portion of another piece of cutlery in the their stacked, nested positions comprising lugs formed on the inside surfaces of the first and second leg portions for abutting with and support on the outside surface of the top portion of the handle portion of the other piece of cutlery, with the lugs being wedge shaped and including an inside surface and an abutment surface, with the abutment surface having a shape complementary to and for abutment with the outside surfaces of the top portion and the first and second leg portions at their intersections, and wherein the inside surface of the lugs extend at an angle less than 90° from the top portion of the handle portion to form an inverse taper for holding onto the punch of an injection mold during formation of the cutlery, with the bowl portion of the spoon being attached to the second ends of the top portion and the first and second leg portions of the handle portion and being of an elongated oval shape having a length, a width, and a depth, with the tine portion of the fork being attached to the second ends of the top portion and the first and second leg portions of the handle portion and having a length, a width, and a depth equal to the length, the width, and the depth of the bowl portion of the spoon, with the tine portion of the fork including a first tine, a second tine, and a third tine, with the first and third tines being located on opposite sides of the second tine, with the first and third tines being shorter than the second tine allowing the tine portion of the fork to remain in the outline of the bowl portion of the spoon for protecting the tines against breakage due to catching on external objects and for preventing the tines from poking through the packaging in which the cutlery is located when the fork is stacked on top of the spoon, with the blade portion of the knife being attached to the second ends of the top portion and the first and second leg portions of the handle portion and having a length generally equal to the length of the bowl portion of the spoon and tine portion of the fork, with the width of the blade portion of the knife being less than the width of the bowl portion of the spoon and the tine portion of the fork, with the blade portion having a shape which remains in the outline of the bowl portion of the spoon and the tine portion of the fork when the knife is stacked on top of the spoon or on top of the fork for preventing the blade portion from cutting through the packaging of the cutlery.

2. Nestable, stackable cutlery comprising, in combination: a plurality of utensils, with each utensil including a handle portion and a food operational and engagement portion, with the utensils being of a set of a knife, a fork, and a spoon; with the handle portion having a first, stacking and nesting type surface and a second, stacking and nesting type surface allowing the handle portions of the utensils to be stacked and nested together with the first, nesting and stacking type surface of a first utensil being receivable within the second, stacking and nesting type surface of another utensil; and means for supporting the handle portion of the first utensil along its entire length on the handle portion of the other utensil in their stacked, nested positions, with the utensils being stackable with utensils of like kind and with utensils of unlike kinds.

3. The nestable, stackable cutlery of claim 2 wherein the handle portions of the utensils include a generally U-shaped cross section comprising, in combination: a flat top portion having a first end, a second end, a first edge, a second edge, an outside surface, and an inside surface; first and second leg portions, with the first and second leg portions including a first end, a second end, a first edge, a second edge, an outside surface, and an inside surface, with the first edge of the first leg portion being attached at an obtuse angle to the first edge of the top portion and with the first edge of the second leg portion being attached at an obtuse angle to the second edge of the top portion, with the food operational and engagement portion being attached to the second ends of the top portion and the first and second leg portions, with the distance between the second edges of the first and second leg portions being greater than the distance between the first and second edges of the top portion allowing the handle portions of the utensils to be stacked and nested together with the inside surface of the first and second leg portions being positioned above the outside surfaces of the first and second leg portions of another utensil wherein the outside surfaces of the top portion and the first and second leg portions form the first, stacking and nesting type surface of the handle portion, and wherein the inside surfaces of the top portions and the first and second leg portions form the second, stacking and nesting type surface of the handle portion.

4. The nestable, stackable cutlery of claim 2 wherein the plurality of utensils comprises a plurality of spoons.

5. The nestable, stackable cutlery of claim 2 wherein the plurality of utensils comprises a plurality of forks.

6. The nestable, stackable cutlery of claim 2 wherein the plurality of utensils comprises a plurality of knives.

7. The nestable, stackable cutlery of claim 2 wherein the plurality of utensils include a spoon, a fork, and a knife.

8. The nestable, stackable cutlery of claim 7 wherein the food operational and engagement portion of the spoon comprises an elongated, oval-shaped bowl portion having a length, a width, and a depth; wherein the food operational and engagement portion of the fork comprises a tine portion having first, second, and third tines, with the tine portion having a length, a width, and a depth equal to the length, width, and depth of the bowl portion of the spoon, with the first and third tines being located on opposite sides of the second tine, with the first and third tines being shorter than the second tine of the tine portion and having a length such that the tine portion keeps in the outline of the bowl portion of the spoon when the fork is stacked on top of the spoon for protecting the tines against breakage due to catching on other objects or for poking through packaging of the cutlery; wherein the food operational and engagement portion of the knife comprises a blade portion having a length generally equal to the length of the bowl portion of the spoon and a width which is less than the width of the bowl portion of the spoon for allowing the blade portion of the knife to keep in the outline of the bowl portion of the spoon when the knife is stacked above the spoon.

9. The nestable, stackable cutlery of claim 2 wherein the supporting means comprises first and second lugs formed on the second, stacking and nesting type surface of the handle portion of the first utensil for abutting with and support on the first, stacking and nesting type surface of the handle portion of the other utensil; wherein the lugs are wedge shaped and include an inside surface and an abutment surface, and wherein the inside surfaces of the first and second lugs extend from the second, stacking and nesting type surface in a non-parallel relation and in planes which converge towards each other at a point spaced from the second, stacking and nesting type surface to form an inverse taper for holding onto the punch of an injection mold during formation.

10. The nestable, stackable cutlery of claim 3 wherein the supporting means comprises first and second lugs formed on the second, stacking and nesting type surface of the handle portion of the first utensil for abutting with and support on the first, stacking and nesting type surface of the handle portion of the other utensil; wherein the lugs include an abutment surface having a shape complementary to and for abutment with the outside surfaces of the top portion and the first and second leg portions at their intersection.

11. The nestable, stackable cutlery of claim 2 wherein the plurality of utensils include a fork and a knife.

12. The nestable, stackable cutlery of claim 11 wherein the food operational and engagement portion of the fork comprises a tine portion having first, second, and third tines, with the tine portion have a length, a width, and a depth, with the first and third tines being located on opposite sides of the second tine, with the first and third tines being shorter than the second tine of the tine portion; and wherein the food operational and engagement portion of the knife comprises a blade portion having a length generally equal to the length of the tine portion of the fork and a width which is less than the width of the tine portion of the fork for allowing the blade portion of the knife to keep in the outline of the tine portion of the fork when the knife is stacked on the fork.

13. The nestable, stackable cutlery of claim 2 wherein the plurality of utensils include a spoon and a fork.

14. The nestable, stackable cutlery of claim 13 wherein the food operational and engagement portion of the spoon comprises an elongated, oval-shaped bowl portion having a length, a width, and a depth; and wherein the food operational and engagement portion of the fork comprises a tine portion having first, second, and third tines, with the tine portion having a length, a width, and a depth equal to the length, width, and depth of the bowl portion of the spoon, with the first and third tines being located on opposite sides of the second tine, with the first and third tines being shorter than the second tine of the tine portion and having a length such that the tine portion keeps in the outline of the bowl portion of the spoon when the fork is stacked on top of the spoon for protecting the tines against breakage due to catching on other objects or for poking through packaging of the cutlery.

15. Cutlery comprising, in combination: a spoon having a handle portion and a bowl portion; a fork having a handle portion and a tine portion; a knife having a handle portion and a blade portion, with the handle portions of the spoon, fork, and knife being of identical construction, with the handle portion of the fork being stackable on the handle portion of the spoon and with the handle portion of the knife being stackable on the handle portion of the fork and the handle portion of the spoon, with the bowl portion of the spoon being of an elongated oval shape having a length, a width, and a depth, with the tine portion of the fork having a length, a width, and a depth equal to the length, the width, and the depth of the bowl portion of the spoon, with the tine portion of the fork including a first tine, a second tine, and a third tine, with the first and third tines being located on opposite sides of the second tine, with the first and third tines being shorter than the second tine allowing the tine portion of the fork to remain in the outline of the bowl portion of the spoon for protecting the tines against breakage due to catching on external objects and for preventing the tines from poking through packaging in which the cutlery is located; with the length of the blade portion of the knife being generally equal to the length of the bowl portion of the spoon and the tine portion of the fork, with the width of the blade portion of the knife being less than the width of the bowl portion of the spoon and the tine portion of the fork, with the blade portion having a shape which remains in the outline of the bowl portion of the spoon and the tine portion of the fork when the knife is stacked on top of the spoon or on top of the fork for preventing the blade portion from cutting through the packaging of the cutlery.

* * * * *